US005562441A

United States Patent [19]

Döbbeling et al.

[11] Patent Number: 5,562,441

[45] Date of Patent: Oct. 8, 1996

[54] BURNER

[75] Inventors: Klaus Döbbeling, Nussbaumen; Hans P. Knöpfel, Besenbüren, both of Switzerland

[73] Assignee: ABB Research Ltd., Zurich, Switzerland

[21] Appl. No.: 449,868

[22] Filed: May 24, 1995

[30] Foreign Application Priority Data

Jul. 25, 1994 [DE] Germany ..... 44 26 353.8

[51] Int. Cl.[6] ..... F23D 14/46

[52] U.S. Cl. ..... 431/351; 431/173; 431/354

[58] Field of Search ..... 431/350, 351, 431/353, 354, 8, 173, 284, 285, 187

[56] References Cited

U.S. PATENT DOCUMENTS 4,781,030 11/1988 Hellat ..... 431/351
4,932,861 6/1990 Keller et al. ..... 431/354

FOREIGN PATENT DOCUMENTS 0321809 6/1989 European Pat. Off. .
0518072A1 12/1992 European Pat. Off. .
0592717A1 4/1994 European Pat. Off. .

*Primary Examiner*—James C. Yeung
*Attorney, Agent, or Firm*—Burns, Doane, Swecker & Mathis

[57] ABSTRACT

In a burner (100) which essentially comprises at least two hollow, conical sectional bodies (101, 102) nested one inside the other in the direction of flow, the respective longitudinal symmetry axes (101*b*, 102*b*) of the sectional bodies (101, 102) run mutually offset in such a way that the adjacent walls of the sectional bodies (101, 102) form air-inlet slots (119, 120), tangential in their longitudinal extent, for a combustion-air flow (115) in the interior space (114) of the burner. The cross section of flow of these tangential air-inlet slots (119, 120) decreases in the direction of flow of the burner (100) in such a way that this has a positive effect on stabilization of the backflow zone (106) at the outlet of the burner (100).

8 Claims, 4 Drawing Sheets

BURNER

BACKGROUND OF THE INVENTION

1. Field of the Invention

The present invention relates to a burner having two hollow, conical section bodies arranged for define a conical space.

2. Discussion of Background

U.S. Pat. No. 4,932,861 to Keller et al. discloses a premixing burner of double-cone type of construction which essentially comprises two hollow, conical sectional bodies which are nested one inside the other and aligned in the direction of flow and whose respective longitudinal symmetry axes are mutually offset. This mutual offset forms longitudinal ducts or air-inlet slots, between adjacent walls of the sectional bodies, through which ducts or air-inlet slots a combustion-air flow passes tangentially into the conical hollow space. At least one fuel nozzle is positioned in this conical hollow space. This burner represents a leap in quality compared with the prior art as regards flame stabilization, efficiency and pollutant emissions. However, if the load range of such a burner, for example during modulated operation, has to be changed, under certain boundary conditions the flame front, stable per se, can shift upstream and become stable at a poor location for the burner itself as well as for the formation of emissions. This results in problems including overheating of the burner, deterioration in the pollutant emissions and the occurrence of pulsations. In the face of such a situation it is inevitable that the possible load range is restricted.

SUMMARY OF THE INVENTION

Accordingly, one object of the invention as defined in the claims is to provide a novel burner of the type mentioned at the beginning incorporating proposed measures which ensure flame stability even in the transient load range.

Compared with the standard burner, the geometry of the air flow ducts is altered: these ducts have a conically-shaped profile that narrows in the direction of flow, the cross section of flow area of the ducts decreases in the direction of the burner outlet. By this measure, the swirl coefficient, which defines the ratio between the tangential and axial velocity components, experiences a steeper progression along the air flow ducts relative to a uniform cross section of flow. In order to stabilize the flame at the burner outlet reliably, the cross section area of the ducts at the outlet has the original size, which is normally taken as a basis.

The essential advantages of the invention can be seen in the fact that better flame stability over the entire load range, in particular in the lower load range, can thus be achieved. As soon as the flame front remains 100% stable, possible overheating of the burner due to shifting of the flame upstream need no longer be feared.

This flame stability at the optimum location also ensures the minimization of all pollutant emissions, in particular as far as the NOx, UHC (=unsaturated hydrocarbons) and CO discharge is concerned.

By virtue of this maximized flame stabilization, the burner also becomes less susceptible to vibrations, which, excited by combustion processes for example, typically can be intensified over the combustion-space and flue system.

A further essential advantage of the invention can be seen in the fact that a restriction of the load range no longer has to be taken into consideration.

Advantageous and expedient further developments of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
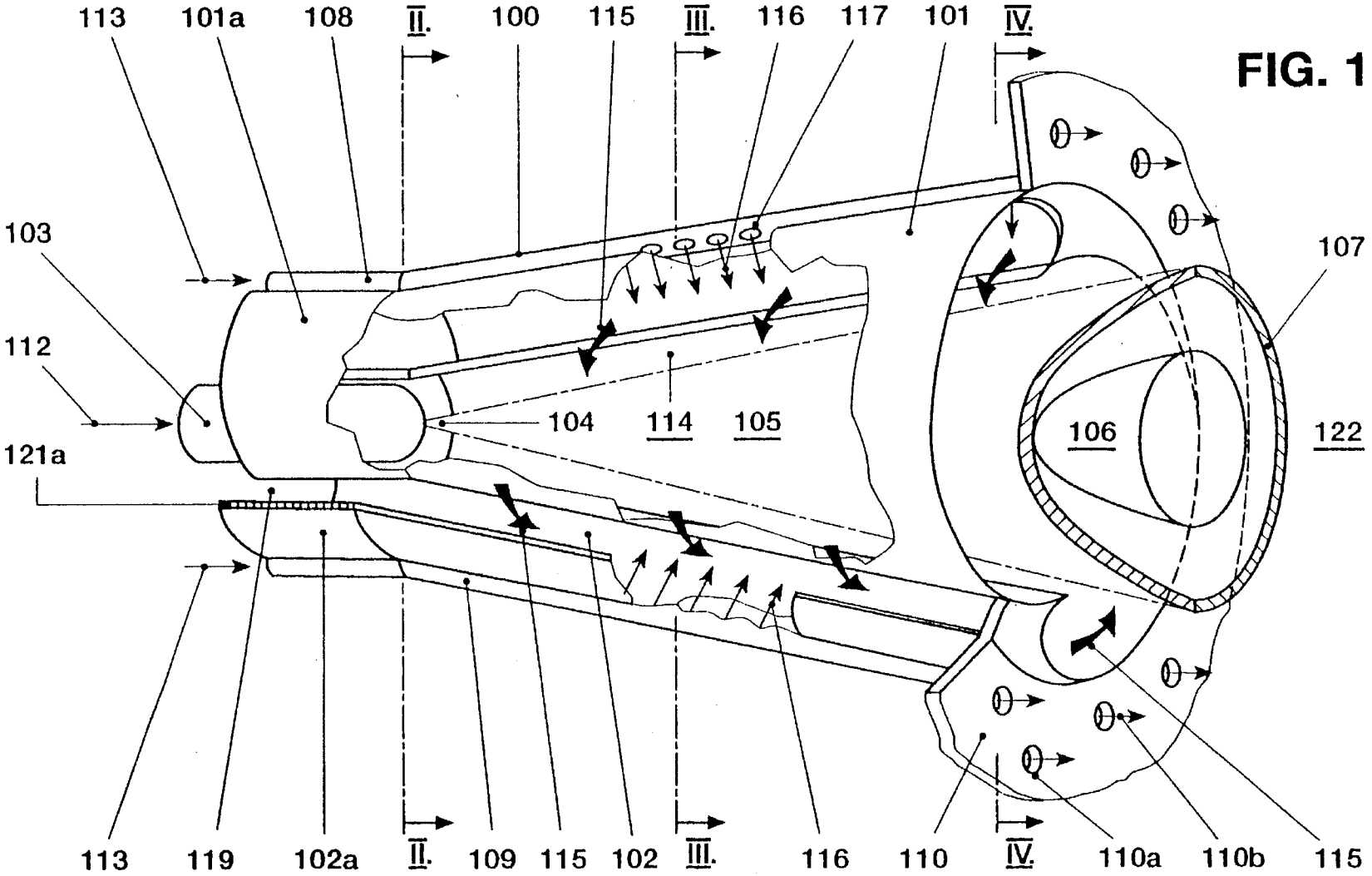
FIG. 1 shows a premixing burner designed as a "double-cone burner" in perspective representation, in appropriate cut-away section.

Referring now to the drawings, wherein like reference numerals designate identical or corresponding parts throughout the several views, all elements not necessary for directly understanding the invention have been omitted, and the direction of flow of the various media is indicated by arrows.

Figure 2:
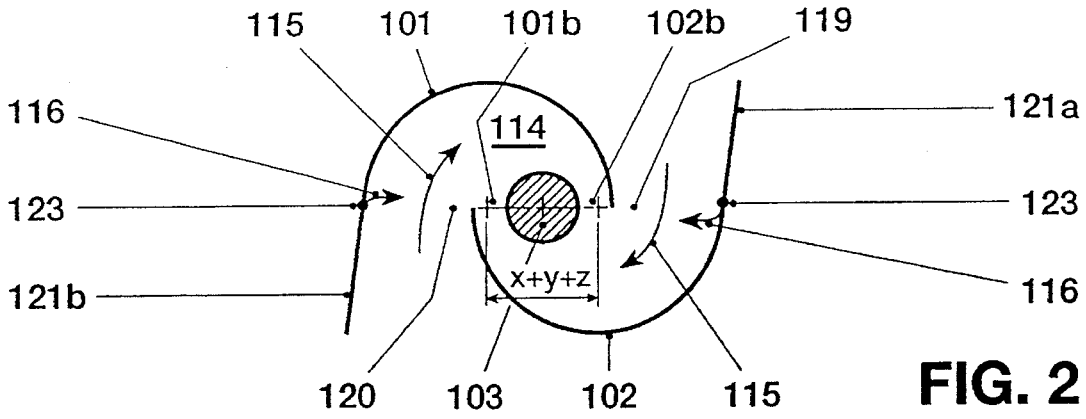
FIGS. 2–4 show corresponding sections through various planes of the premixing burner according to FIG. 1.
Figure 3:
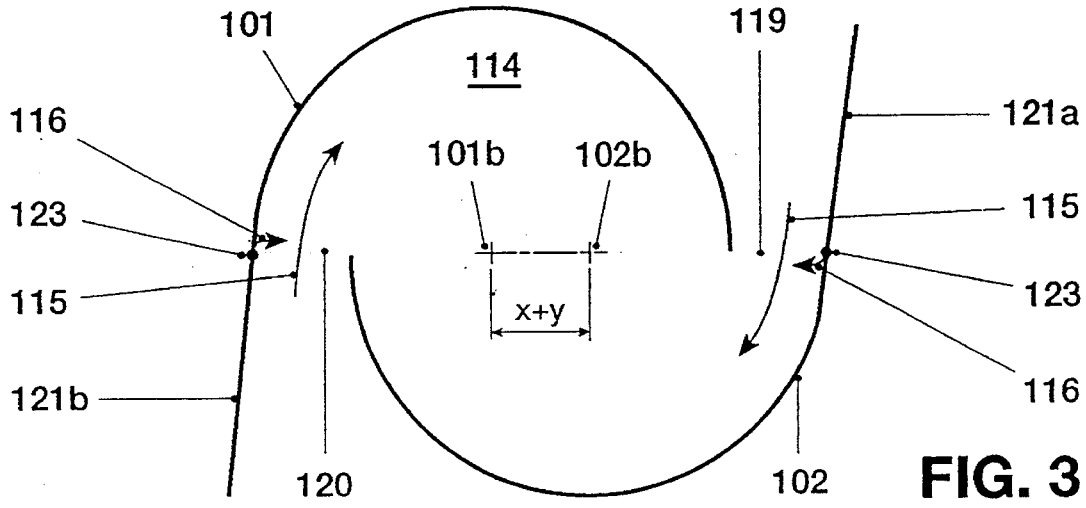
Figure 4:
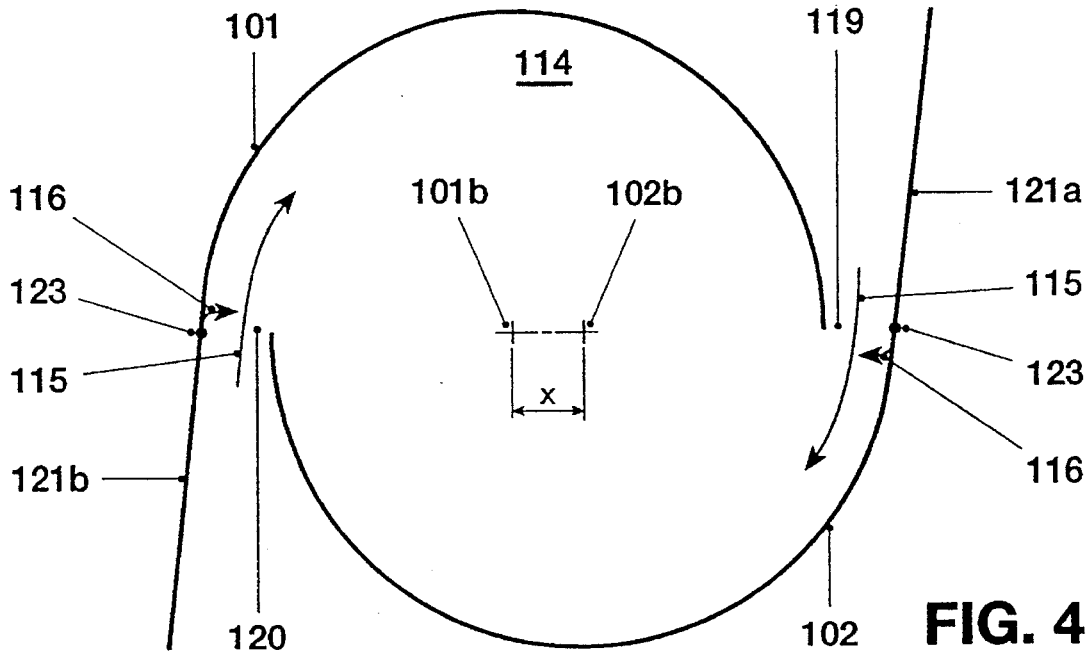
Figure 5:
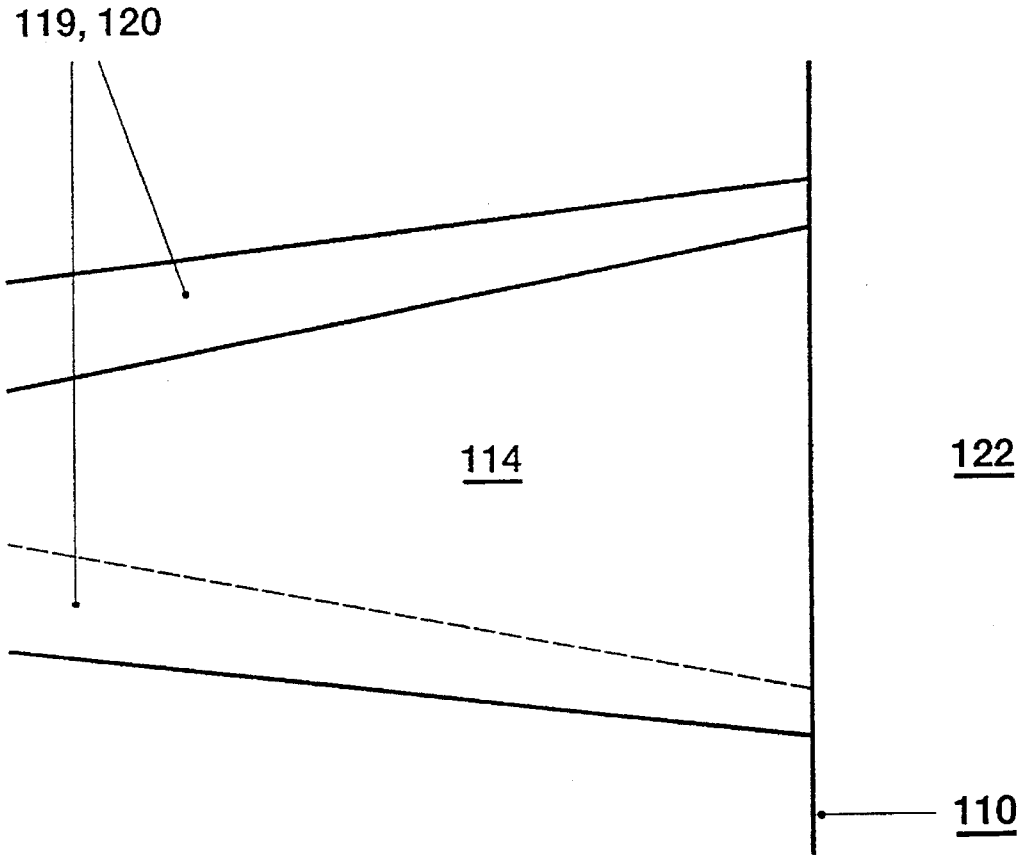
FIG. 5 shows a schematic representation of the conical profile of the air-inlet slots.

In order to understand better the construction of the premixing burner 100, it is of advantage if the individual sections according to FIGS. 2–4, and if need be also FIG. 5, are used at the same time as FIG. 1. Furthermore, in order to avoid making FIG. 1 unnecessarily complicated, the baffle plates 121*a*, 121*b* shown schematically according to FIGS. 2–4 are only indicated by position in FIG. 1. The description of FIG. 1 below also makes reference to the remaining figures when required.

Figure 6:
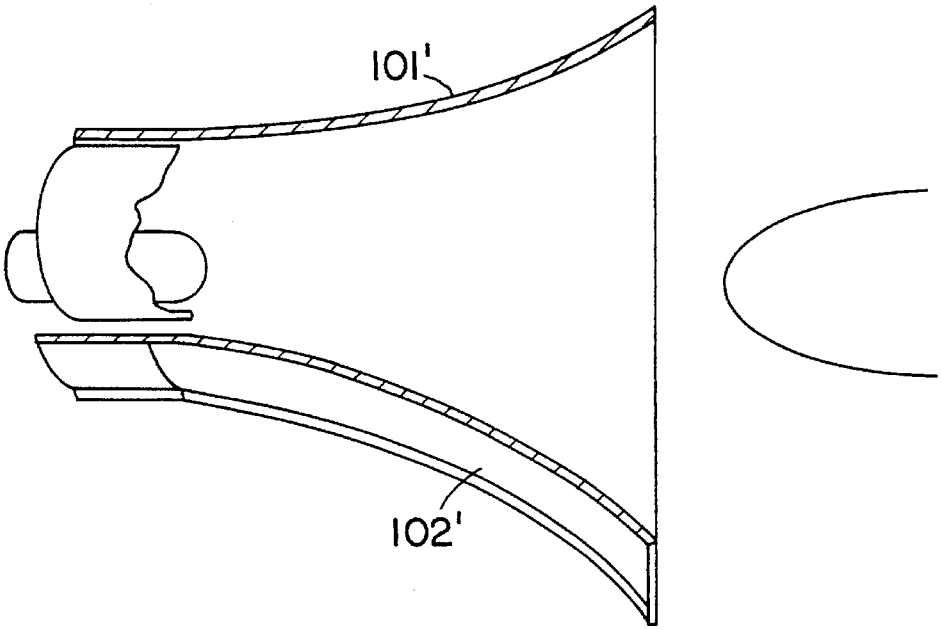
FIG. 6 is a section view of a burner with sectional bodies 101' and 102' having a constantly increasing cone angle, and, FIG. 7 is a sectional view of a burner with sectional bodies 101" and 102" having a constantly decreasing cone angle.
Figure 7:
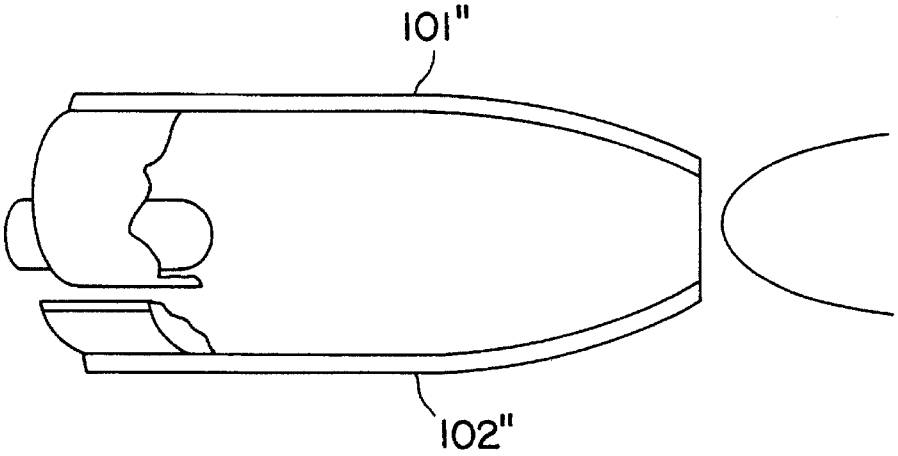

The premixing burner 100 according to FIG. 1 comprises two hollow conical sectional bodies 101, 102 which are nested one inside the other in a mutually offset manner. The mutual offset of the respective center axis or longitudinal symmetry axis 201*b*, 202*b* of the conical sectional bodies 101, 102 provides on both sides, in mirror-image arrangement, an air-inlet slot 119, 120 (FIGS. 2–4), through which the combustion air 115 flows tangentially into the interior space of the premixing burner 100, i.e. into the conical hollow space 114. The cross section area of flow of these air-inlet slots 119, 120 decreases in the direction of flow, it being possible for the progression to be continuous with a conical profile or intermittent. FIG. 5 shows such a configuration as regards the conical profile progression of the air-inlet slots 119, 120. The conical shape of the sectional bodies 101, 102 shown has a certain fixed angle in the direction of flow. Of course, depending on the operational use, the sectional bodies can be shaped with a constantly increasing angle, or with a constantly decreasing angle, as illustrated, respectively, by the bodies 101" and 102" in FIG. 6 and the bodies 101" and 102" FIG. 7 in the direction of flow, similar to a trumpet or tulip.

The two conical sectional bodies 101, 102 each have a cylindrical initial part 101*a*, 102*a*, which parts likewise run offset from one another in a manner analogous to the conical sectional bodies 101, 102, so that the tangential air-inlet slots 119, 120 are present over the entire length of the premixing burner 100. Accommodated in the region of the cylindrical initial part is a nozzle 103, the fuel injection pattern 104 of which coincides approximately with the narrowest cross section of the conical hollow space 114 formed by the conical sectional bodies 101, 102. The injection capacity of this nozzle 103 and its type depend on the predetermined parameters of the respective premixing burner 100. It is of course possible for the premixing burner to be of a purely conical design, that is without cylindrical initial parts 101*a*, 102*a*. Furthermore, the conical sectional bodies 101, 102 each have a fuel line 108, 109, arranged along the tangential inlet slots 119, 120 and are provided with injection openings 117, through which preferably a gaseous fuel 113 is injected into the combustion air 115 flowing through there, as the arrows 116 are intended to symbolize. These fuel lines 108, 109 are preferably positioned at the end of the tangential inflow, before entering the conical hollow space 114, in order to obtain optimum air/fuel mixing. On the combustion-space side 122, the outlet opening of the premixing burner 100 merges into a front wall 110 in which there are a number of bores 110*a*. The bores come into operation when required and ensure that diluent air or cooling air 110*b* is fed to the front part of the combustion space 122. In addition, this air feed provides for flame stabilization at the outlet of the premixing burner 100. This flame stabilization becomes important when it is a matter of supporting the compactness of the flame as a result of radial flattening. The fuel fed through the nozzle 103 is a liquid fuel 112, which if need be can be enriched with a recycled exhaust gas. This fuel 112 is injected at an acute angle into the conical hollow space 114. Thus a conical fuel profile 105 forms from the nozzle 103, which fuel profile 105 is enclosed by the rotating combustion air 115 flowing tangentially into the space 114 through the inlet slots 119, 120. The concentration of the fuel 112 is continuously reduced in the axial direction toward the outlet by the inflowing combustion air 115 to give optimum mixing. If the premixing burner 100 is operated with a gaseous fuel 113, this preferably takes place via opening nozzles 117, the forming of this fuel/air mixture being achieved directly at the end of the air-inlet slots 119, 120. When the fuel 112 is injected via the nozzle 103, the optimum, homogeneous fuel concentration over the cross section is achieved in the region of the vortex breakdown, that is in the region of the backflow zone 106 at the end of the premixing burner 100. The ignition is effected at the tip of the backflow zone 106. Only at this point can a stable flame front 107 develop. A flashback of the flame into the interior of the premixing burner 100, as is potentially the case in known premixing sections and attempts to combat which are made with complicated flame retention baffles, need not be feared here. The design of the air-inlet slots 119, 120 provides lasting assistance here: the cross section of flow of these air-inlet slots 119, 120 decreases in the direction of flow, that is from the burner head to the burner outlet, according to a conical profile, as is readily apparent from FIG. 5. But the other FIGS. 2–4 also show the decreasing cross section of the air-inlet slots 119, 120 in the direction of flow very well. By this measure, the swirl coefficient, which defines the ratio between the tangential and axial velocity components, experiences a steeper progression along the tangential air-inlet slots relative to a uniform cross section of flow. Narrow limits must in any case be adhered to in the configuration of the conical sectional bodies 101, 102 with regard to the cone angle and the cross section of flow of the tangential air-inlet slots 119, 120 so that the desired flow field of the combustion air 115 can arise with the backflow zone 106 at the outlet of the premixing burner 100. The decreasing cross section of flow of the tangential air-inlet slots 119, 120 in the direction of flow intensifies the stability of the flame front in the region of the burner outlet. To this it must be added that a reduction in the cross section of flow inside the tangential air-inlet slots 119, 120 inevitably displaces the backflow zone upstream, although this results in the mixture being ignited earlier, which from the aspects acknowledged above is not desirable. If the combustion air 115 is additionally preheated or enriched with a recycled exhaust gas, this provides assistance for the evaporation of the liquid fuel 112 before the combustion zone is reached. The same considerations also apply if liquid fuels are supplied via the lines 108, 109 instead of gaseous fuels. Returning to the configuration of the tangential air-inlet slots 119, 120, it can generally be stated that the backflow zone 106, once it is fixed, is positionally stable per se, for the swirl coefficient increases in the direction of flow in the region of the conical profile shape of the premixing burner 100, which is here additionally assisted by the decreasing cross section of flow of the tangential air-inlet slots 119, 120 in the direction of flow, which becomes noticeable in an especially positive manner in the transient range. Furthermore, the axial velocity inside the premixing burner 100 can be changed by a corresponding feed (not shown) of an axial combustion-air flow, i.e. intensification of this axial flow can be effected to help stabilize the backflow zone 106 at the burner outlet. Furthermore, the construction of the premixing burner 100 is excellently suitable for adapting the size and the progression of the tangential air-inlet slots 119, 120, whereby a relatively large operational range can be covered without changing the overall length of the premixing burner 100. The sectional bodies 101, 102 can of course also be displaced relative to one another in another plane, and even an overlap of the bodies is possible. It is even possible if required to nest the sectional bodies 101, 102 spiral-like one inside the other by a counter-rotating movement.

The geometric configuration of the baffle plates 121*a*, 121*b* is illustrated in from FIGS. 2–4. They have a flow-initiating function, and extend, in accordance with their length, the respective ends of the conical sectional bodies 101, 102 in the direction of the oncoming-flow the combustion air 115. The channeling of the combustion air 115 into the conical hollow space 114 can be optimized by opening or closing the baffle plates 121*a*, 121*b* about a pivot 123 placed into the conical hollow space 114 in the region of the inlet of this duct, and this can especially be necessary if the cross section of flow of the tangential air-inlet slots 119, 120 is configured in accordance with FIGS. 2–4. These dynamic measures can of course also be provided statically by makeshift baffle plates forming a fixed integral part with the conical sectional bodies 101, 102. The premixing burner 100 can likewise also be operated without baffle plates, or other aids can be provided for flow initiation.

FIG. 5, already touched upon several times, is intended to show schematically how the progression of the tangential air-inlet slots 119, 120 is preferably to be provided. A certain alternative to the action of the decreasing cross section area of flow of the tangential air-inlet slots 119, 120 can be achieved by the sectional bodies 101, 102 of the premixing burner 100 being formed according to the trumpet shape already acknowledged.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A burner comprising;

at least two hollow, conical sectional bodies positioned to define a conical space having a longitudinal flow direction, respective longitudinal symmetry axes of the bodies being mutually offset so that adjacent walls of the sectional bodies form longitudinal inlet ducts for a tangentially directed combustion-air flow into the conical space, and at least one fuel nozzle positioned in the conical space formed by the sectional bodies, wherein the bodies are shaped so that a cross section flow area of the inlet ducts decreases in the flow direction.

2. The burner as claimed in claim 1, further comprising additional fuel nozzles arranged in a region of the inlet ducts in the longitudinal direction.

3. The burner as claimed in claim 1, wherein the cross section flow area of the tangential ducts has a conical profile in the flow direction of the burner (100).

4. The burner as claimed in claim 1, wherein the sectional bodies are shaped to widen conically at a fixed angle in the flow direction.

5. The burner as claimed in claim 1, wherein the sectional bodies are shaped with a constantly increasing angle in the flow direction.

6. The burner as claimed in claim 1, wherein the sectional bodies are shaped with a constantly decreasing angle in the flow direction.

7. The burner as claimed in claim 1, wherein the sectional bodies are nested spiral-like one inside the other.

8. A burner comprising:

at least two hollow conical sectional bodies positioned to define a conical space having a longitudinal flow direction, respective longitudinal symmetry axes of the bodies being mutually offset so that adjacent walls of the sectional bodies form longitudinal inlet ducts for a tangentially directed combustion-air flow into the conical space, and at least one fuel nozzle positioned in the conical space formed by the sectional bodies, wherein the bodies are shaped so that a cross section flow area of the inlet ducts has a conical profile decreasing in the flow direction.

* * * * *